US005111247A

United States Patent [19]

Nichols

[11] Patent Number: 5,111,247

[45] Date of Patent: May 5, 1992

[54] TONER CONCENTRATION SENSING USING AUGER MOUNTED MAGNET

[75] Inventor: Stephen J. Nichols, Rochester, N.Y.

[73] Assignee: Xerox Corporation, Stamford, Conn.

[21] Appl. No.: 738,028

[22] Filed: Jul. 30, 1991

[51] Int. Cl.[5] ..... G03G 15/06; B01F 15/00

[52] U.S. Cl. ..... 355/246; 355/245; 366/142

[58] Field of Search ..... 355/245, 246; 366/142

[56] References Cited

U.S. PATENT DOCUMENTS

| | | | |
|---|---|---|---|
| 4,075,977 | 2/1978 | Williams | 118/658 |
| 4,200,665 | 4/1980 | Suzuki et al. | 355/246 X |
| 4,378,754 | 4/1983 | Rasekhi et al. | 118/658 |
| 4,514,480 | 4/1985 | Wada et al. | 355/246 X |
| 4,868,601 | 9/1989 | Morimoto et al. | 355/246 X |
| 4,956,669 | 9/1990 | Nakamura | 355/246 X |
| 4,959,690 | 9/1990 | Trainor et al. | 355/245 |
| 4,963,929 | 10/1990 | Ueda et al. | 355/246 X |

FOREIGN PATENT DOCUMENTS

| | | |
|---|---|---|
| 59-166976 | 9/1984 | Japan . |
| 60-107664 | 6/1985 | Japan . |
| 62-289873 | 12/1987 | Japan . |
| 60-80879 | 9/1991 | Japan . |

*Primary Examiner*—A. T. Grimley
*Assistant Examiner*—Nestor R. Ramirez
*Attorney, Agent, or Firm*—Oliff & Berridge

[57] ABSTRACT

A toner concentration sensing system is disclosed for controlling the dispensing of toner into a developer sump. A toner concentration sensor is located in the bottom of the mixing area of the developer sump adjacent one of the mixing augers. The toner concentration sensor can be positioned flush with the bottom of the mixing chamber or the sensor can project slightly from the bottom of the chamber. A magnet is positioned on the rotating mixing auger for rotating with the auger past the toner concentration sensor. As the auger rotates, the magnet with developer material adhering thereto, sweeps the top of the toner sensor to improve the accuracy of the toner concentration readings. A toner dispenser is actuated when the detected toner concentration goes below a predetermined limit.

20 Claims, 5 Drawing Sheets

TONER CONCENTRATION SENSING USING AUGER MOUNTED MAGNET

BACKGROUND OF THE INVENTION

This invention relates generally to an electrophotographic printing machine, and more particularly concerns an apparatus for controlling dispensing of marking particles into a developer unit.

In a typical electrophotographic printing process, a photoconductive member is sensitized by charging its surface to a substantially uniform potential. The charged portion of the photoconductive member is exposed to a light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

It is generally well known that the density or concentration of toner particles has to be maintained within an appropriate range in order to continuously obtain copies having a desired density. However, toner particles are being continuously depleted from the developer material as copies are being formed. Many types of systems have been developed for detecting the concentration of toner particles in the developer material. For example, a test patch recorded on the photoconductive surface is developed to form a solid area of developer material. Generally, the density of the developer material developed on the test patch is monitored by an infrared densitometer. The density of the developed test patch, as measured by the infrared densitometer, is compared to a reference level. The resulting error is detected by a control system that regulates the dispensing of toner particles from a storage container.

However, such a system used to replenish toner particles into the developer material is fairly inaccurate, since the repeatability of the toner particle flow under identical conditions is poor. As a result, the amount of toner particles actually dispensed fluctuates around the average value set by the control system. Accordingly, accurate toner particle concentration will not reduce the control bandwidth. One of the major causes of the wide control bandwidth is the delay built into the control loop. The control loop detects low toner particle concentration after this condition has been reached and does not anticipate the requirement to furnish additional toner particles before the low toner particle concentration condition is reached. In addition, added toner particles have to be mixed with the developer material and charged to the appropriate level. Mixing and charging of the toner particles requires time in addition to time required to develop the test patch.

SUMMARY OF THE INVENTION

It is an object of the present invention to provide a toner dispenser control with decreased response time and improved accuracy.

It is another object of the present invention to provide a sensor for sensing the concentration of toner particles in the developer sump adjacent one of the mixing augers in the developer sump.

It is still another object of the present invention to provide a toner concentration sensor immediately adjacent a mixing auger having a magnet thereon for detecting toner concentration as the toner moves past the sensor due to the rotation of the auger.

It is yet another object of the present invention to provide a sensor below a mixing auger, the sensor projecting toward the blade of the auger, the auger having a magnet mounted above the sensor for rotation past the sensor.

These and other objects of the present invention are achieved by a developer mechanism and method for determining a concentration of toner particles within a two-component development machine in which two-component developer material comprises the toner particles and carrier granules in a reservoir, the toner particles being selectively attracted to a charged receptor surface. The developer material in the reservoir is mixed by the rotation of at least one auger within the reservoir. An amount of toner particles is sensed in the reservoir with a sensor mounted below one auger, and a magnet is mounted on the auger for rotation therewith, the sensor being positioned within a magnetic field of the magnet when the magnet faces the sensor.

The surface of the sensor is brushed with a developer brush to remove agglomerated developer material thereon, the developer brush comprising developer material magnetically adhering to the magnet mounted on the auger. Because of the tendency of developer material to clump on the surface of the sensor, the signal sensed by the sensor can be inaccurate. By utilizing a brush of developer materials adhering to the rotating magnet, the surface of the sensor is brushed clean at each rotation of the auger to improve the accuracy of the sensed toner concentration.

BRIEF DESCRIPTION OF THE DRAWINGS

The foregoing and other objects, features and advantages of the invention will be apparent in the following more detailed description of preferred embodiments of the invention in connection with accompanying drawings wherein.

DETAILED DESCRIPTION OF THE PREFERRED EMBODIMENTS

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
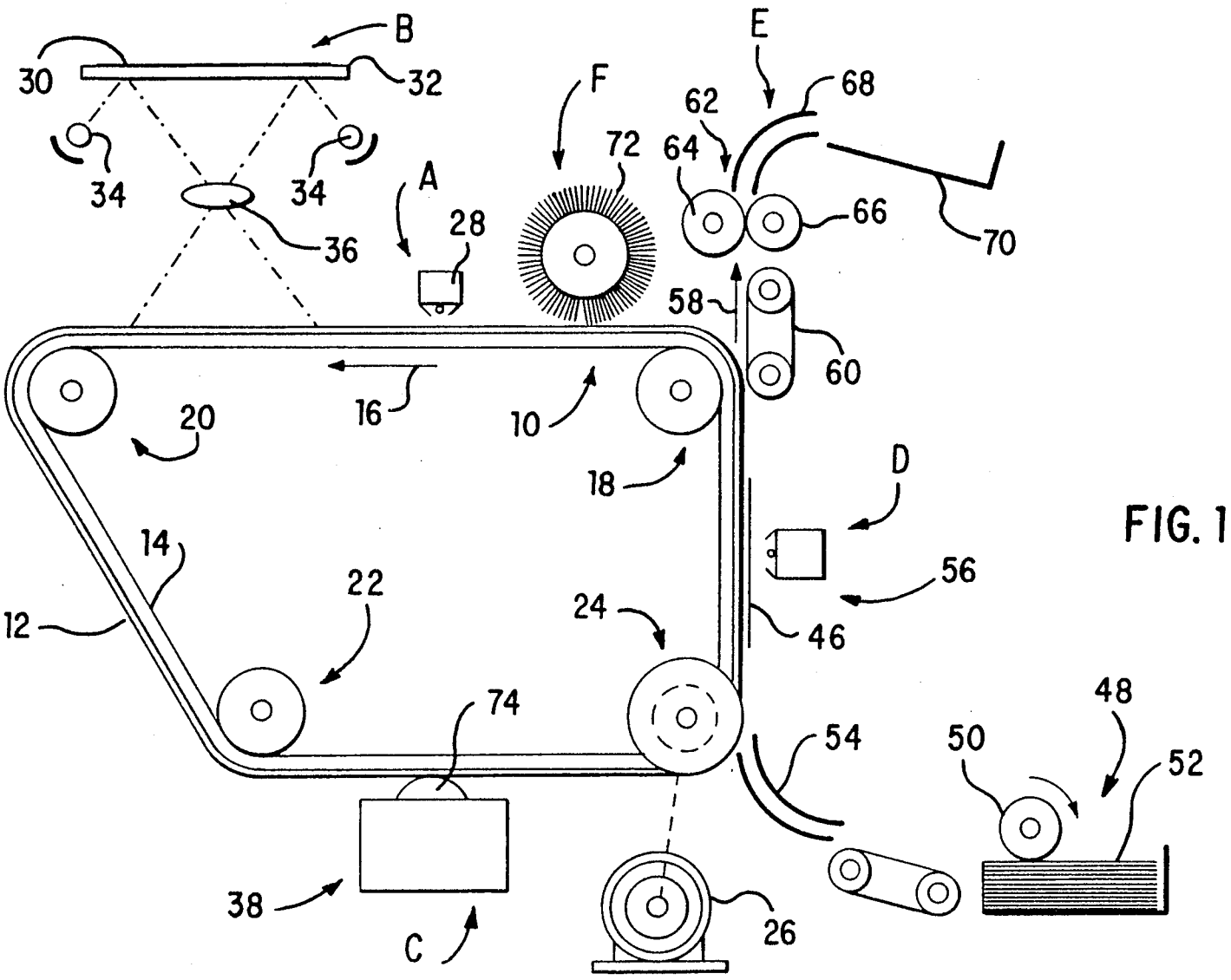
FIG. 1 is a schematic elevational view depicting an electrophotographic printing machine incorporating the toner concentration controller of the present invention.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the toner concentration control of the present invention therein. It will become evident from the following discussion that this toner concentration control is equally well suited for use in a wide variety of printing machines and is not necessarily limited in its application to the particular embodiment depicted herein.

1. Electrophotographic Printing Using Toner Concentration Control

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to informational areas contained within original document 30 disposed upon transparent plate 32. In place of lamps 34 could be used a fluorescent light bulb which slow scans the document. If the document is scanned the signal can be digitized to activate a laser for forming the latent image on the belt. Thereafter, belt 10 advances the electrostatic latent image recorded on photoconductive surface 12 to development station C.

At development station C, a developer unit, indicated generally by the reference numeral 38, transports a two-component developer material of toner particles and carrier into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIGS. 2-5.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 50 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

The foregoing description is sufficient for purposes of the present application to illustrate the general operation of an exemplary electrophotographic printing machine incorporating the features of the present invention therein.

Figure 2:
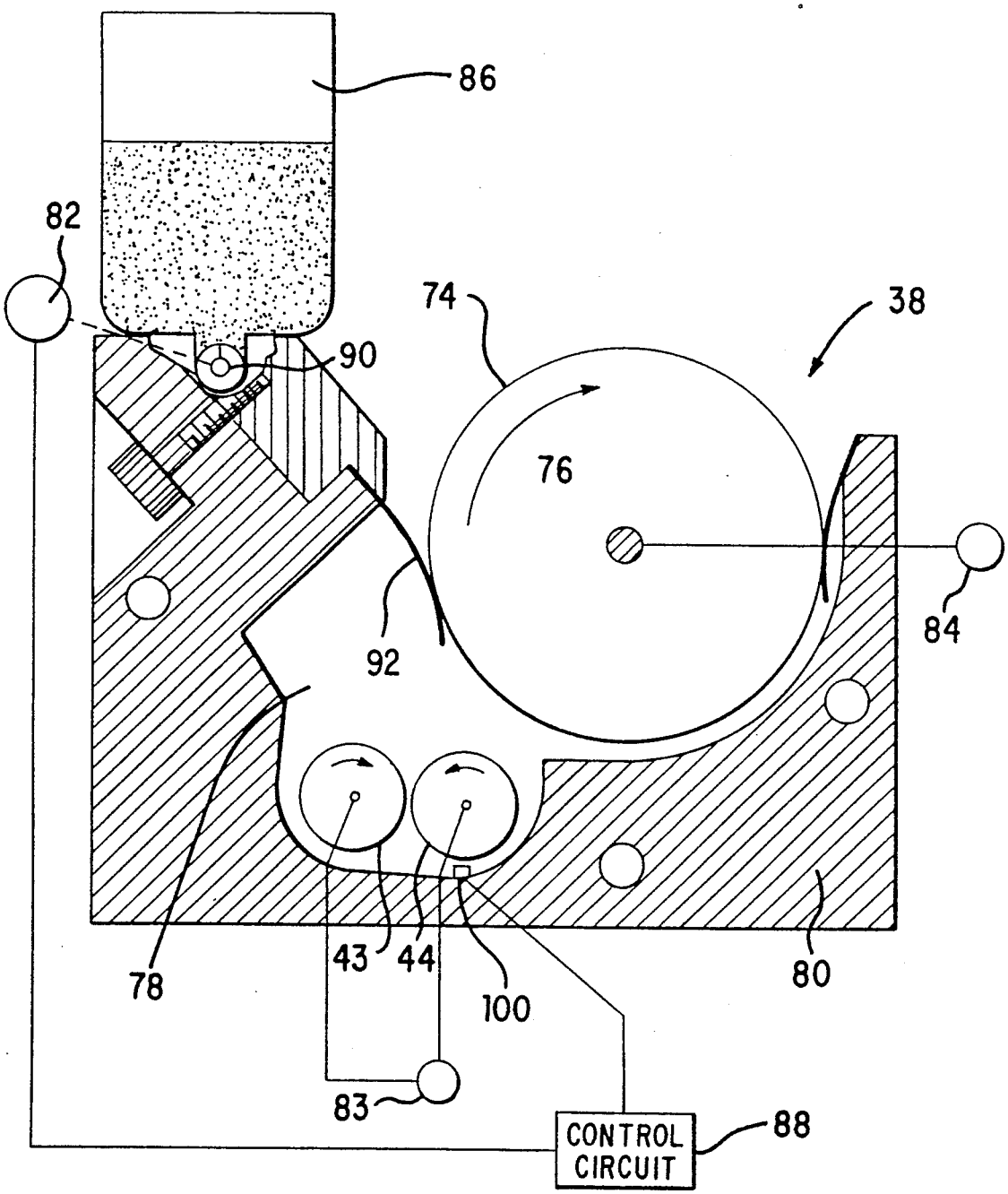
FIG. 2 is a schematic elevational view showing the development apparatus used in the FIG. 1 printing machine.

Referring now to FIG. 2, the detailed structure of developer unit 38 is shown. The developer unit includes a donor roller 74. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor 84 which rotates donor roller 74 in the direction of arrow 76. Donor roller 74 is positioned, at least partially, in chamber 78 of housing 80.

Toner mixing augers, indicated generally by the reference numerals 43, 44, mix and fluidize the toner and carrier particles. The fluidized toner particles seek their own level under the influence of the gravity. Inasmuch as new toner particles are being discharged from container 86 into one end of the chamber 78 of housing 80, the force exerted on the toner and carrier particles by the rotating augers moves the toner and carrier particles around chamber 78. Augers 43, 44 are located in chamber 78 closely adjacent to the bottom wall of chamber 78. New toner particles are discharged into one end of chamber 78 from container 86. As augers 43, 44 are rotated by motor 83 in the direction of arrows, toner particles move in one direction along one auger and in the opposite direction along the second auger so that toner is mixed and fluidized in a circular direction. The fluidized toner particles being moved are attracted to donor roller 74.

The concentration of the toner is measured by toner concentration sensor 100 located at any position adjacent auger 44, such as above (0°), below (180°) or beside (90°, 270°) auger 44. In FIG. 2, sensor 100 is located directly beneath auger 44 in a longitudinal direction beneath the auger away from the new toner dispensing end of the chamber. The control signal from the sensor regulates via control circuit 88 the energization of motor 82. Motor 82 is connected to auger 90 located in the open end of container 86. As auger 90 rotates, it discharges toner from container 86 into chamber 78 of housing 80.

Donor roller 74 rotates in the direction of arrow 76 to move the toner particles attracted thereto into contact with the electrostatic latent image recorded on photoconductive surface 12 of belt 10. As donor roller 74 rotates in the direction of arrow 76, charging blade 92 has the region of the free end thereof resiliently urged into contact with donor roller 74. Charging blade 92 may be made from a metal, silicone rubber, or a plastic material. By way of example, charging blade 92 may be made from steel phosphor bronze and ranges from about 0.025 millimeters to about 0.25 millimeters in thickness, being a maximum of 25 millimeters wide. The free end of the charging blade extends beyond the tangential contact point with donor roller 74 by about 4 millimeters or less. Charging blade 82 is maintained in contact with donor roller 74 at a pressure ranging from about 10 grams per centimeter to about 250 grams per centimeter. The toner particle layer adhering to donor roller 74 is charged to a maximum of 60 microcoulombs/gram.

Many different materials are known for use in the manufacture of donor roller 74. Donor rollers are known which are made from aluminum or steel. Alternatively, donor rollers are made of an anodized metal or a metal coated with a material. For example, a polytetrafluoroethylene based resin such as Teflon, a trademark of the Du Pont Corporation, or a polyvinylidene fluoride based resin, such as Kynar, a trademark of the Pennwalt Corporation, may be used to coat the metal roller. Such a coating acts to assist in charging the particles adhering to the surface thereof. Still another type of known donor roller is a stainless steel plated by a catalytic nickel generation process and impregnated with Teflon.

Figure 3:
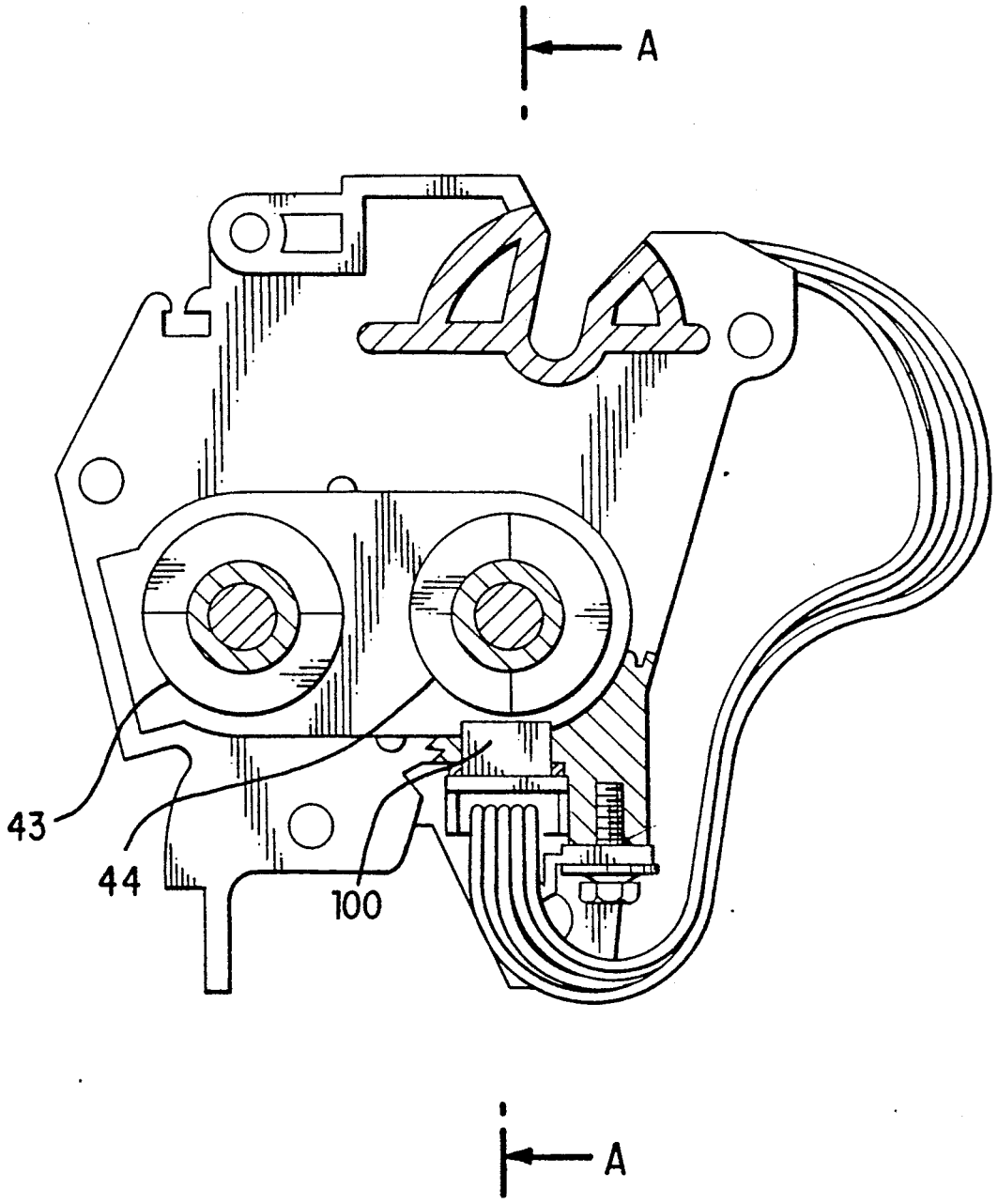
FIG. 3 is a schematic view of the developer sump with mixing augers and toner concentration sensor.

As can be seen in FIG. 3, the two mixing augers 43, 44 are located adjacent each other for mixing and fluidizing the toner and carrier particles. Though toner concentration sensor 100 is located below mixing auger 44 in FIG. 3, the sensor can be located adjacent either mixing auger.

Figure 4:
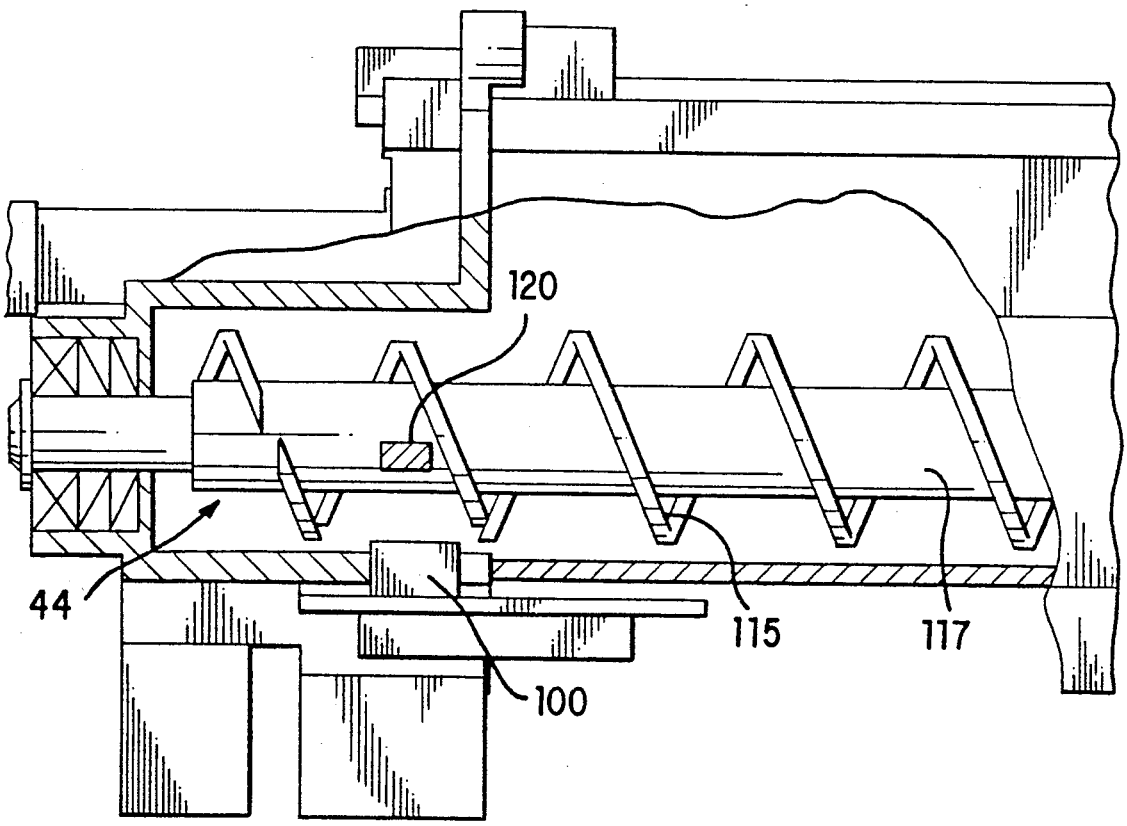
FIG. 4 is a side view along line A—A of FIG. 3, of one of the two mixing augers with a magnet attached thereto and a toner concentration sensor located therebelow.

As can be seen in FIG. 4 (taken along line A—A of FIG. 3), the toner concentration sensor 100 is not flush with the bottom of the mixing chamber. The toner concentration sensor 100 projects from the bottom of the chamber towards the mixing auger to ensure that actively flowing developer material is sensed by the sensor. The concentration sensor should be located towards the end of the mixing auger which is away from the area where fresh toner is added to the mixing area. In FIG. 4, the concentration sensor 100 is located toward the left end of the auger 44, such that new toner added to the mixing area would be added toward the right end of auger 44 in FIG. 4. Auger 44 has a blade portion 115 and a core portion 117.

Figure 5:
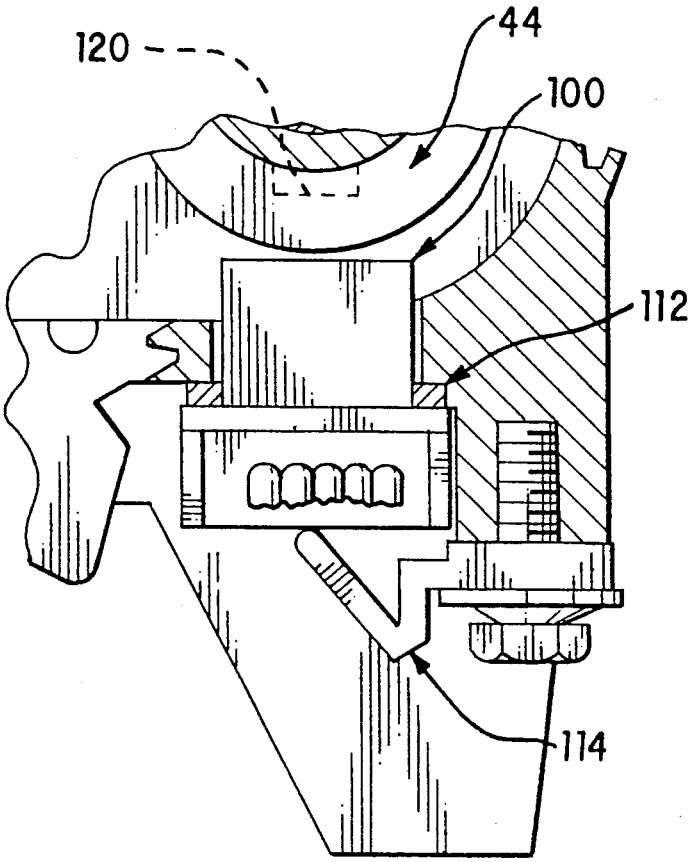
FIG. 5 is a schematic sectional view of the toner concentration sensor.

As can be seen in FIG. 5, the sensor 100 located under auger 44 is held in place by a gasket 112 and a plastic spring 114. The spring 114 provides a biasing force against the sensor 100 so that the sensor projects into the mixing area toward the auger 44.

Referring again to FIG. 4, magnet 120 is positioned on auger 44 to rotate with auger 44 during toner and carrier mixing and fluidization. Magnet 120 is positioned on the auger directly above toner concentration sensor 100, such that magnet 120 rotates directly past the sensor. The magnet should not project from the auger too far as problems can result due to the interference of the magnet with the compression of the developer material caused by the auger. For example, if the magnet is weak, the magnet must pass in rotation very close to the sensor, which can cause fusing of toner onto the sensor. The magnet is positioned preferably 0.6 to 0.8 millimeters behind the edge of the auger blade. The poles of magnet 120 can be directed in almost any direction so long as on each rotation, the surface of the sensor is subjected to the magnetic field of the magnet. For example, the poles could be directed in a radial, tangential or axial direction of the auger, the radial direction causing less disturbance to the wave form detected by the sensor.

Though the magnet is shown in FIGS. 4 and 5 as being raised, the magnet may also be positioned flush with the bottom of the developer sump. As the magnet rotates past the toner sensor, the magnet brushes the surface of the sensor with a "developer brush." The developer brush is formed due to the magnetic adherence of the developer material to the magnet on the auger. During each rotation of the auger, the developer brush sweeps the surface of the toner concentration sensor to remove any agglomerated developer material thereon (agglomeration tending to occur particularly in high humidity environments). Because agglomerated developer material on the sensor decreases the accuracy of the sensed toner concentration, the developer brush continuously cleans the sensor surface and improves the accuracy of the sensed signal due to the toner concentration.

The distance between the magnet and sensor as the magnet passes the sensor depends on the strength of the magnet. The magnet can be of almost any type (as long as it is sufficiently small to be positioned on the auger and has sufficient strength). Preferably the magnet has a strength of about 500 gauss or more. In one embodiment, the magnet is from about 1.1 to about 1.4 millimeters from the sensor, with a field strength of about 1000 to 1160 gauss. Magnets of suitable size and strength are, for example, plastic MgO (1.8 MgO) BPK or TPK magnets. It is also envisioned that a commercially available alarm-type magnet, cobalt magnet or ceramic magnet could also be used in the present invention. Any suitable permeability sensor can be used. A preferred arrangement is a permeability sensor with an inductor coil where toner particles near the coil increase the inductance in the coil.

A peak detect and hold circuit or a suitable software equivalent can be used to filter the AC signal of the auger (approximately 3 hertz) to detect the peak of the signal due to the toner concentration. Because the sensor outputs an AC signal due to the rotation of the auger, it is necessary to filter the output signal to get the peak. Using a software peak and hold, the output can be sampled at a rate approximately 30 times higher than the auger frequency. It is then possible to detect the peak output of the sensor which corresponds directly to the concentration of the toner material. A high peak is the result of a lower toner concentration, and a low peak is due to a higher toner concentration. The sampling is performed continuously over a period of time longer than the period of the AC signal. It is also necessary to reset the peak value held in software in order to obtain a new peak signal.

The present invention allows for a 9 to 10% toner concentration range for operability. A less sensitive sensor will result in a broader range of up to 20%. The present invention is thus very beneficial due to the large increase in range potential. In addition, problems caused by humidity and temperature are greatly reduced in the present invention. In conventional toner concentration sensing systems, humidity and temperature can result in over a 2% toner concentration error. The auger mounted magnet of the present invention decreases the toher concentration error to $\frac{1}{4}$ to $\frac{1}{2}$%. As in other toner dispenser control systems, when the toner concentration exceeds a predetermined limit, the toner dispenser is actuated to add more toner to the developer sump.

The invention has been described in detail with particular reference to preferred embodiments thereof, but it will be understood that variations and modifications can be affected within the spirit and scope of the invention as described hereinabove and as defined in the appended claims. For example, the magnet could be mounted partially or fully within the core of the auger, more than one magnet could be used (such as a second magnet and a second sensor mounted in another location, or a second magnet mounted 180° from the first magnet for passing adjacent the same sensor), or the magnet/sensor arrangement might be used in a single component developer system.

What is claimed is:

1. A developer mechanism for determining a concentration of toner particles within a printing machine in which developer material comprises toner particles in a reservoir, the toner particles being selectively attracted to a charged receptor surface, the developer mechanism comprising:

at least one auger rotatably mounted in the reservoir for mixing the developer material, the at least one auger having a blade and core;

a sensor mounted in the reservoir adjacent to the at least one auger for sensing an amount of said toner particles in the reservoir;

a magnet mounted on the at least one auger for rotation therewith to brush the surface of the sensor with a developer brush to remove agglomerated developer material on the sensor, the sensor being positioned within a magnetic field of the magnet when the magnet faces the sensor during said rotation;

a filtering means for filtering a signal detected by the sensor; and wherein the sensor outputs an AC signal having a frequency due to the rotation of the at least one auger, the filtering means determining the peak of the AC signal due to the concentration of said toner particles.

2. The developer mechanism of claim 1, wherein said sensor is positioned directly below said at least one auger, the magnet in rotation passing directly above said sensor.

3. The developer mechanism of claim 2, wherein the distance between the surface of the magnet and the surface of the sensor is from about 1.1 mm to about 1.4 mm when said magnet faces said sensor.

4. The developer mechanism of claim 1, wherein said magnet is selected from the group consisting of a plastic MgO magnet, a plastic BPK magnet, a plastic TPK magnet, a ceramic magnet, and an alarm-type magnet.

5. The developer mechanism of claim 1, wherein the magnet has a field strength greater than about 500 gauss.

6. The developer mechanism of claim 1, wherein said filtering means is a peak detect and hold circuit.

7. The developer mechanism of claim 1, further comprising a toner dispenser, the toner dispenser being actuated to dispense new toner particles when the sensed concentration of the toner particles in said reservoir by said sensor goes below a predetermined value.

8. The developer mechanism of claim 1, wherein the poles of said magnet extend in a tangential, axial or radial direction from said at least one auger.

9. The developer of claim 1, wherein the filtering means is a programmable device.

10. A method for determining a concentration of toner particles within a printing machine in which developer material comprises toner particles in a reservoir, the toner particles being selectively attracted to a charged receptor surface, the method comprising the steps of:

mixing said developer material in the reservoir by rotation of at least one auger therein, the at least one auger having a blade and a core;

sensing an amount of toner particles in the reservoir with a sensor mounted adjacent to said at least one auger in the reservoir;

positioning the sensor within a magnetic field of a magnet mounted on the core of the at least one auger for rotation with the at least one auger to brush the surface of the sensor with a developer brush to remove agglomerated developer materials thereon, the developer brush comprising developer material magnetically adhering to the magnet;

filtering a signal detected by the sensor; and wherein the sensor outputs an AC signal having a frequency due to the rotation of the auger, the filtering means determining the peak of the AC signal due to the concentration of the toner particles.

11. The method of claim 10, wherein the sensor is positioned directly below the at least one auger, the magnet in rotation passing directly above the sensor.

12. The method of claim 11, wherein the distance between the surface of the magnet and the surface of the sensor is from about 1.1 mm to about 1.4 mm when the magnet faces the sensor.

13. The method of claim 10, wherein the magnet is selected from the group consisting of a plastic MgO magnet, a plastic BPK magnet, a plastic TPK magnet, a ceramic magnet, and an alarm-type magnet.

14. The method of claim 10, wherein the magnet has a field strength greater than about 500 gauss.

15. The method of claim 10, wherein the step of filtering comprises the use of a peak detect and hold circuit for detecting the peak of the AC signal due to the rotation of the auger.

16. The method of claim 10, further comprising the step of dispensing toner from a toner dispenser, wherein the toner dispenser is actuated to dispense new toner particles when the sensed concentration of toner particles in said reservoir by said sensor goes below a predetermined value.

17. The method of claim 10, wherein the poles of the magnet extend in a tangential, axial or radial direction from the auger.

18. A developer mechanism for determining a concentration of toner particles within a printing machine in which developer material comprises toner particles in a reservoir, the toner particles being selectively attracted to a charged receptor surface, the developer mechanism comprising:

at least one auger rotatably mounted in a reservoir for mixing the developer material, the at least one auger having a blade and core;

a sensor mounted in the reservoir adjacent to the at least one auger for sensing an amount of said toner particles in the reservoir;

a magnet mounted on the at least one auger for rotation therewith to brush the surface of the sensor with a developer brush to remove agglomerated developer material on the sensor, the sensor being positioned within a magnetic field of the magnet when the magnet faces the sensor during said rotation;

a filtering means for filtering a signal detected by the sensors; and wherein said filtering means is a peak detect and hold device.

19. The mechanism of claim 18, wherein the peak detect and hold device is a circuit.

20. The mechanism of claim 18, wherein the peak detect and hold device is a programmable device.

* * * * *